US008113297B2

(12) United States Patent
Sakakibara et al.

(10) Patent No.: US 8,113,297 B2
(45) Date of Patent: Feb. 14, 2012

(54) POWER TOOL WITH ERGONOMIC HANDLE

(75) Inventors: Kazuyuki Sakakibara, Anjo (JP); Kiyozumi Kokawa, Anjo (JP)

(73) Assignee: Makita Corporation, Anjo-Shi (JP)

( * ) Notice: Subject to any disclaimer, the term of this patent is extended or adjusted under 35 U.S.C. 154(b) by 0 days.

(21) Appl. No.: 12/961,984

(22) Filed: Dec. 7, 2010

(65) Prior Publication Data

US 2011/0079409 A1 Apr. 7, 2011

Related U.S. Application Data

(63) Continuation of application No. 11/347,363, filed on Feb. 6, 2006, now abandoned.

(30) Foreign Application Priority Data

Feb. 10, 2005 (JP) ..... 2005-035286

(51) Int. Cl.
*B25F 5/02* (2006.01)

(52) U.S. Cl. ..... 173/170; 173/217; 173/162.1; 173/171; D8/68; 227/156

(58) Field of Classification Search ..... 173/217, 173/170–171, 162.1, 162.2; D8/68; 7/167–168; 81/171.1, 177.5; 227/156, 162.1
See application file for complete search history.

(56) References Cited

U.S. PATENT DOCUMENTS 3,019,673 A 2/1962 Sjostrand et al.
4,330,093 A 5/1982 Chapman, Jr.
5,353,474 A 10/1994 Good et al.
D380,952 S 7/1997 Kim
5,711,379 A 1/1998 Amano et al.
D395,387 S 6/1998 Snider
D403,220 S 12/1998 Kimata et al.
6,161,256 A 12/2000 Quiring et al.

(Continued)

FOREIGN PATENT DOCUMENTS

DE 92 09 725 U1 11/1992

(Continued)

OTHER PUBLICATIONS

Extended European Search Report from corresponding European patent application No. 06 002 390, including Search Opinion and Search Report (claims correspond directly to original claims 1-11).

(Continued)

*Primary Examiner* — Lindsay Low
*Assistant Examiner* — Michelle Lopez
(74) *Attorney, Agent, or Firm* — J-Tek Law PLLC; Jeffrey D. Tekanic

(57) ABSTRACT

A power tool includes a body, a tool bit, a driving mechanism and a handgrip extending from an end of the handgrip proximal to the body to a grip distal end in a direction that crosses the axial direction of the tool bit. The power tool includes a holding optimization region that is arranged on the handgrip and shaped to match the shape of the user's fingers while the user is holding the handgrip. The holding optimization region at least includes a rearward end surface of a grip distal end region configured such that a normal extending from the rearward end surface crosses the axial direction of the tool bit forward of the handgrip, whereby it is possible to optimize the force of the user's fingers and palm applied to the handgrip.

22 Claims, 9 Drawing Sheets

U.S. PATENT DOCUMENTS

| | | | | |
|---|---|---|---|---|
| 6,362,600 | B2 | 3/2002 | Sakakibara | |
| 6,392,381 | B1 | 5/2002 | Chen | |
| D459,966 | S | 7/2002 | So | |
| 6,446,734 | B1 | 9/2002 | Williams et al. | |
| 6,840,335 | B1 | 1/2005 | Wu | |
| D519,808 | S | 5/2006 | Otsuka et al. | |
| 7,096,974 | B2 | 8/2006 | Obermeier et al. | |
| 7,140,451 | B2 | 11/2006 | Yoshimizu et al. | |
| 7,143,841 | B2 * | 12/2006 | Etter et al. | 173/170 |
| 2001/0011884 | A1 | 8/2001 | Sakakibara | |
| 2003/0146008 | A1 | 8/2003 | Andriolo | |
| 2004/0029426 | A1 | 2/2004 | Lui et al. | |
| 2004/0106036 | A1 | 6/2004 | Geis et al. | |
| 2005/0121209 | A1 | 6/2005 | Shimizu et al. | |
| 2005/0247466 | A1 * | 11/2005 | Andriolo et al. | 173/170 |
| 2005/0257944 | A1 | 11/2005 | Cooper | |
| 2006/0143866 | A1 * | 7/2006 | Lagaly et al. | 16/430 |
| 2006/0175069 | A1 * | 8/2006 | Sakakibara et al. | 173/217 |
| 2010/0252293 | A1 * | 10/2010 | Lopano et al. | 173/170 |

FOREIGN PATENT DOCUMENTS

| | | |
|---|---|---|
| DE | 201 02 675 U1 | 5/2001 |
| DE | 203 15 329 U1 | 2/2002 |
| EP | 0 142 650 | 5/1985 |
| EP | 0 261 260 | 3/1988 |
| GB | 2 169 541 | 7/1986 |
| JP | 2-56580 U | 4/1990 |
| JP | 9-295285 | 11/1997 |
| JP | 11-221781 | 8/1999 |
| JP | 2001-162565 | 6/2001 |
| JP | 2001-198856 | 7/2001 |
| JP | 2001-211559 | 8/2001 |
| JP | 2002-254341 | 9/2002 |
| JP | 2002-273667 | 9/2002 |
| JP | 2002-337074 | 11/2002 |
| JP | 2003-209960 | 7/2003 |

OTHER PUBLICATIONS

Applicant's Response to the Extended European Search Report from corresponding European patent application No. 06 002 390, including arguments, amended claims and amended description (includes summaries of certain references cited above).

English translation of Office Action from priority Japanese patent application No. 2005-035286 dated Oct. 21, 2009 (based upon claims similar to original claims 1-11).

Extended European Search Report from corresponding European patent application No. 08 020 330, including Search Opinion and Search Report (with claims 1-13 as searched and examined attached thereto).

Applicant's Response to the Extended European Search Report from corresponding European patent application No. 08 020 330, including arguments, amended claims and amended description (includes summaries of certain references cited above).

English translation of Third-Party Submission filed against priority Japanese patent application No. 2005-035286.

* cited by examiner

POWER TOOL WITH ERGONOMIC HANDLE

CROSS-REFERENCE

This application is a continuation of U.S. patent application Ser. No. 11/347,363, filed on Feb. 6, 2006 now abandoned, which claims priority to Japanese patent application no. 2005-25286 filed on Feb. 10, 2005.

BACKGROUND OF THE INVENTION

1. Field of the Invention

The present invention relates to techniques for designing and constructing a handgrip of a power tool.

2. Description of the Related Art

Japanese Pre-Grant Patent Publication No. 2002-254341 discloses a power tool, in which a tool bit is driven by an electric motor. This power tool includes a body, a tool bit mounted on a tip end portion of the body, an electric motor housed within the body to drive the tool bit, and a handgrip that extends from an upper end of the grip proximal to the body down to the distal end of the grip in a direction that crosses the axial direction of the tool bit.

Improved techniques for reducing the load on the user's fingers are desired for a wide variety of hand-held power tools.

SUMMARY OF THE INVENTION

Accordingly, it is an object of the present teachings to provide effective techniques or designs capable of reducing the load on the user's fingers when holding a power tool.

In one aspect of the present teachings, a representative power tool may include a body, a tool bit mounted on a tip end portion of the body, a driving mechanism housed within the body and configured to drive the tool bit, and a handgrip that extends from the end of the handgrip closest or proximal to the body to the distal end of the grip in a direction that crosses the axial direction of the tool bit. The term "power tool" broadly includes electric-, pneumatic- or gas powered tools used, e.g., for tightening (e.g. various kinds of screws), cutting, grinding, polishing, nailing, riveting, drilling or other similar operations. Further, the power tool includes a holding optimization region that is arranged on the handgrip and is shaped to match shape of the user's fingers when the user is holding or gripping the handgrip. In embodiments, in which the handgrip is shaped or configured to match the shape of the user's fingers as much as possible when the user is holding the handgrip, the amount of force or load that the user's fingers are required to apply to the handgrip in order to hold the power tool can be optimized.

Optionally, the holding optimization region may include at least one of first to fourth portions. The first portion is disposed on the rearward end surface of the distal end region of the grip and is configured such that a normal extending from the rearward end surface crosses the axis of the tool bit forward of the handgrip. The first portion may be formed only on the grip distal end. In the alternative, a plurality of such first portions may be formed within a predetermined region between the grip distal end and the end of the grip proximal to the body. The user can operate the power tool while evenly pressing the first portion of the handgrip in the direction towards the tip end of the tool. Such a handgrip configuration reduces fatigue and pain in the user's hand during extended power tool operations.

The second portion is disposed on a front surface of the trigger such that a normal extending from the front surface of the trigger crosses the axis of the tool bit forward of the handgrip.

The third portion is a region of the handgrip having a plurality of oval cross-sections taken in a direction parallel to the axial direction of the tool bit. A first oval cross-section has a maximum diameter portion, wherein both its major axis and minor axis are a maximum, while a second oval cross-section has a minimum diameter portion, wherein both its major axis and minor axis are a minimum. The maximum diameter portion may be disposed in an intermediate region of the handgrip between the end of the grip proximal to the body and the grip distal end, whereas the minimum diameter portion may be disposed nearer to the grip distal end than the maximum diameter portion. In this case, the major and minor axes gradually decrease from the intermediate region towards the grip distal end. Consequently, the maximum diameter portion may be disposed in the intermediate region of the handgrip, while the minimum diameter portion may be disposed nearer to the grip distal end than the maximum diameter portion. In such an embodiment, the holding force of the entire palm can be effectively utilized when holding the handgrip.

The fourth portion of the handgrip is configured such that an imaginary S-shaped connecting line continuously and vertically connects vertexes of the plurality of oval cross-sections on a lateral side surface of the handgrip, such that an upper end of the S-shaped line is directed toward a rearward end of the end of the grip proximal to the body and a lower end of the S-shaped line is directed toward a front end of the grip distal end. In such an embodiment, the vertexes (convex portions) of the grip lateral side surface snugly fit into the hollow (concave) portion formed by the palm when the user holds the handgrip. As a result, the force of the user's fingers can be efficiently applied to the handgrip.

Preferably, the S-shaped connecting line, which continuously and vertically connects the vertexes on the lateral side surface of the handgrip, may extend substantially along a heart line or a head line of the user's palm while the handgrip is being held. This configuration enables the hollow (concave) portion of the user's palm to conform, in particular, to the heart line or the head line on the user's palm when holding the handgrip.

Other objects, features and advantages of the present invention will be readily understood after reading the following detailed description together with the accompanying drawings and the claims.

DETAILED DESCRIPTION OF THE INVENTION

Each of the additional features and method steps disclosed above and below may be utilized separately or in conjunction with other features and method steps to provide and manufacture improved power tools and method for using such power tools and devices utilized therein. Representative examples of the present invention, which examples utilized many of these additional features and method steps in conjunction, will now be described in detail with reference to the drawings. This detailed description is merely intended to teach a person skilled in the art further details for practicing preferred aspects of the present teachings and is not intended to limit the scope of the invention. Only the claims define the scope of the claimed invention. Therefore, combinations of features and steps disclosed within the following detailed description may not be necessary to practice the invention in the broadest sense, and are instead taught merely to particularly describe some representative examples of the invention, which detailed description will now be given with reference to the accompanying drawings.

A representative embodiment of the "power tool" of the present invention will now be described with reference to the drawings. In this embodiment, an electric (battery-powered) impact driver 100 is described as a representative example of the power tool.

Figure 1:
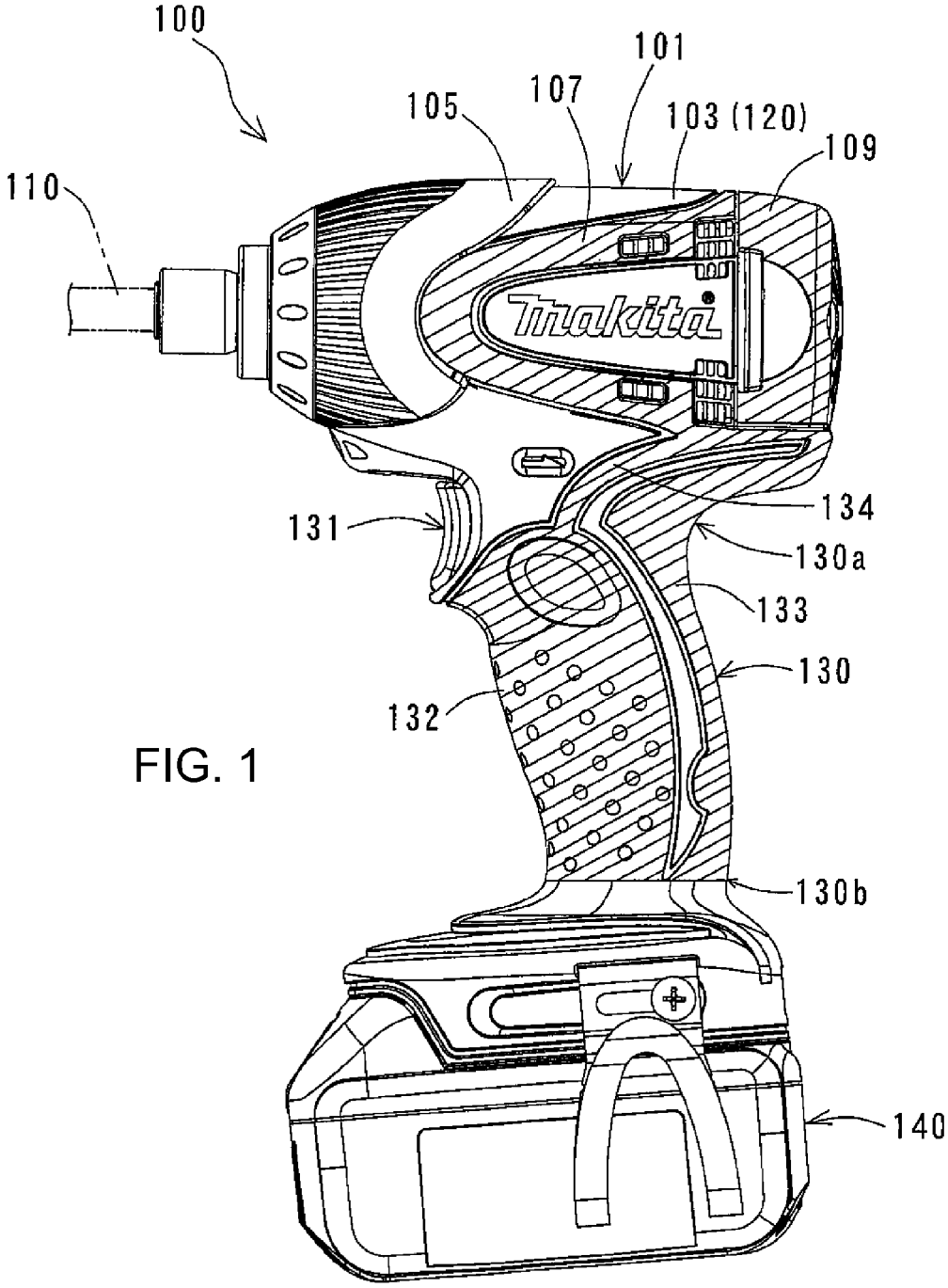
FIG. 1 is a lateral side view showing an impact driver 100 according to an embodiment of the invention.
Figure 2:
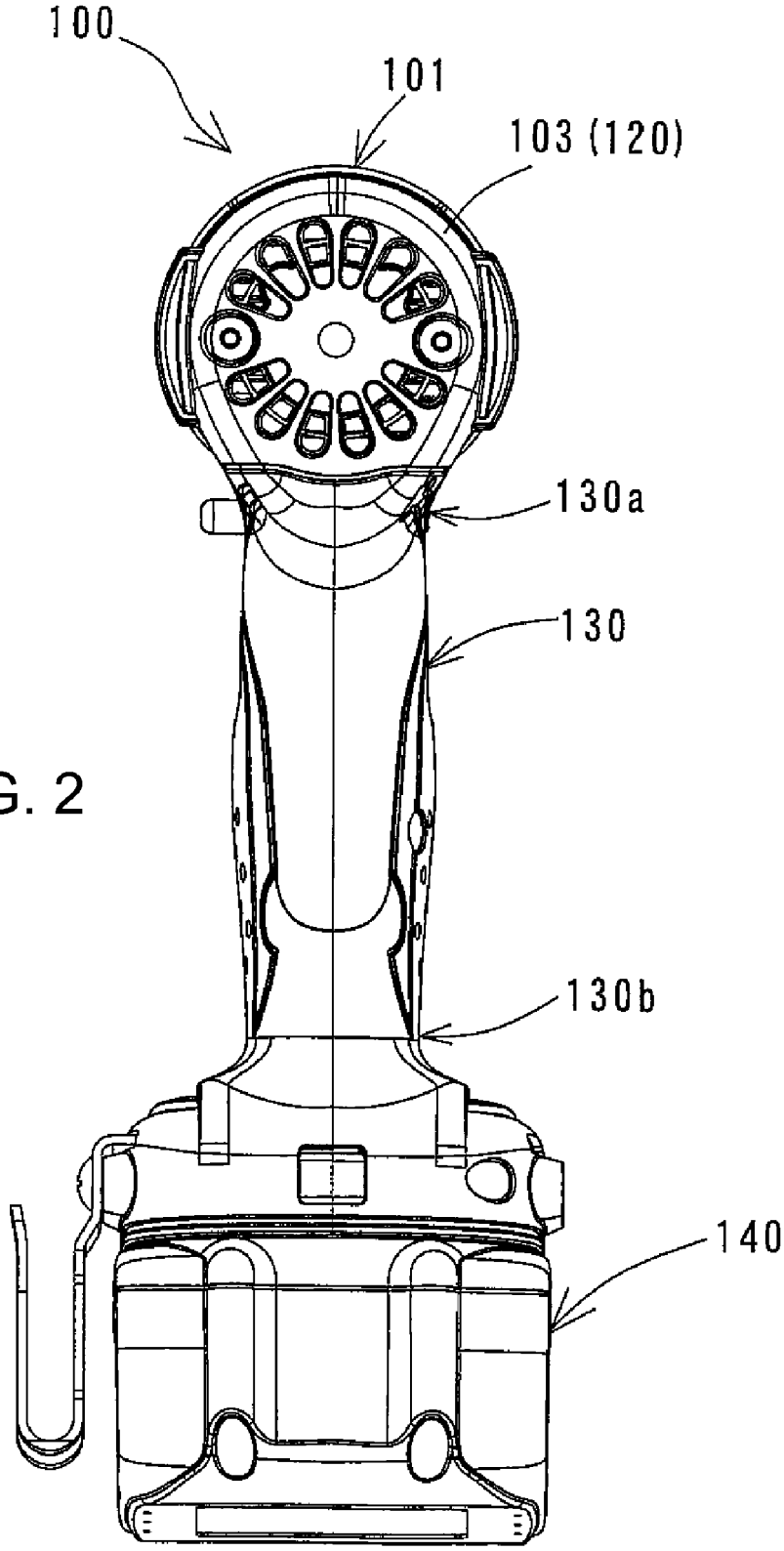
FIG. 2 is a rear view of the impact driver 100 shown in FIG. 1 as viewed from the right side in FIG. 1.

FIGS. 1 and 2 show external views of an impact driver 100 according to the representative embodiment. FIG. 1 is a side view of the impact driver 100 and FIG. 2 is a rear view of the impact driver 100 shown in FIG. 1 as viewed from the right side in FIG. 1.

As shown in FIGS. 1 and 2, the impact driver 100 includes a body 101, a driver bit 110, a driving (electric) motor 120, a handgrip 130 and a battery 140. The driver bit 110 is removably mounted on a tip end portion of the body 101 and is configured to tighten various screws. The driving motor 120 is housed within the body 101.

The body 101 includes a motor housing 103 and a gear housing 105. The body 101 is an example of the "body" according to the present invention. The body 101, however, may also be referred to as the "body" together with the handgrip 130.

The motor housing 103 contains the electric driving motor 120. The driver bit 110 projects from the end of the gear housing 105 and is driven by the driving motor 120. The driving motor 120 is an example that corresponds to the "electric motor" according to this invention. The driver bit 110 is an element driven by the driving motor 120 and is an example that corresponds to the "tool bit mounted on the tip end portion of the body" according to this invention.

Although not explicitly shown, the gear housing 105 contains a speed reducing mechanism for appropriately reducing the rotational speed of an output shaft of the driving motor 120, a spindle that is rotated by the speed reducing mechanism, a hammer that is rotated by the spindle via balls, and an anvil that is rotated by the hammer. The end of the anvil protrudes from the end of the gear housing 105. The driver bit 110 is detachably mounted in this protruding end of the anvil.

The handgrip 130 is a handle held by the user to perform a power tool operation or to carry the power tool. When the user holds the power tool, the user's hand applies a holding (grip) force onto the handgrip. The representative handgrip 130 extends from a grip proximal end 130*a* disposed at the underside of the body 101 to a grip distal end 130*b* in a direction that crosses the axial direction of the driver bit 110 (i.e. it crosses a line that is coaxial with the rotational axis of the driver bit 110). A trigger 131 for actuating a power switch (not shown) of the driving motor 120 is provided on the front portion of the handgrip 130. The trigger 131 is operated by the user to start and stop the driving motor 120.

Further, the body 101 has a casing or housing made of a hard material (a hard synthetic resin material or another similar material). A cushion made of a soft material (a soft synthetic resin material, rubber material or another similar material), which is softer than the hard material, is further provided around the casing. The cushion is indicated with diagonal shading in FIG. 1 and, for example, includes a lateral side contact portion 107, a rear contact portion 109, a grip front contact portion 132, a grip rear contact portion 133 and a connecting portion 134. The lateral side contact portion 107 is formed on both lateral surfaces of the body 101 and the rear contact portion 109 is formed on the rearward end surface of the body 101. The grip front contact portion 132 is formed on the front and lateral surfaces of the handgrip 130 and the grip rear contact portion 133 is formed on the rearward end surface of the handgrip 130. The connecting portion 134 connects the lateral side contact portion 107, the grip front contact portion 132 and the grip rear contact portion 133. By providing the cushion in such a design, the impact driver 100 can provide the user, who is holding the handgrip 130 during a power tool operation, with a soft grip feel as well as a novel appearance.

The battery 140 is removably attached to a battery holder disposed on the distal end portion (lower end portion) of the handgrip 130. The battery 140 has a plurality of cylindrical cells (rechargeable batteries), which are not shown, as the power source for supplying current to the driving motor 120. The cells are contained within the housing of the battery 140 and are arranged horizontally. Instead of this construction, one or more of the cylindrical cells may also be arranged in an inverted vertical position within the housing. Further, various kinds of boards and wiring that connect the driving motor 120 to the battery 140 are accommodated within the internal space of the handgrip 130.

Figure 3:
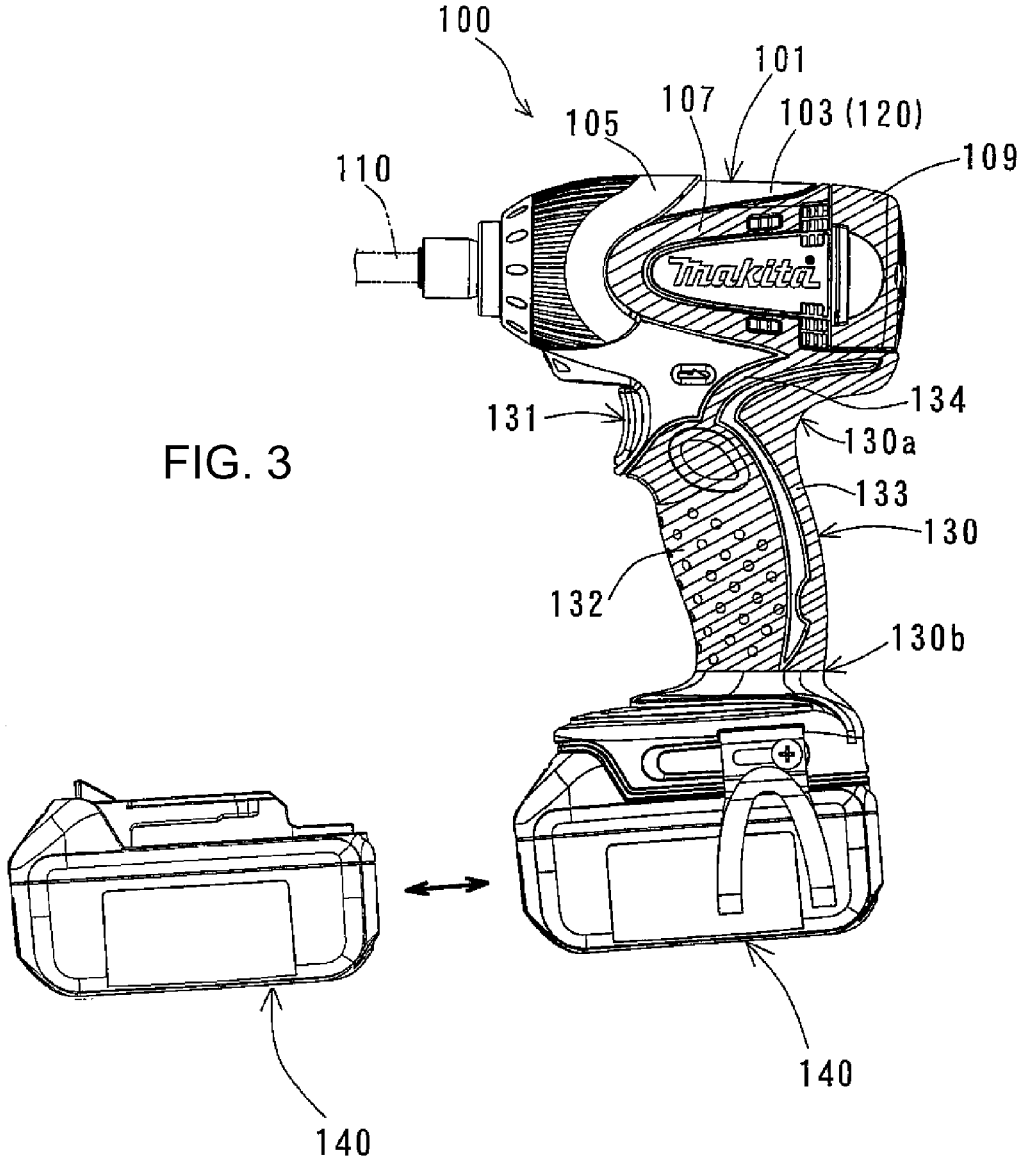
FIG. 3 shows a battery 140 of the impact driver 100 shown in FIG. 1 in the attached state and in the detached state.

FIG. 3 shows the battery 140 of the impact driver 100 shown in FIG. 1 both in the attached state and in the detached state. As shown in FIG. 3, the housing of the cylindrical cells of the battery 140 does not project upwardly, either partial or entirely, from the upper surface of the battery. Thus, in the battery attached state, the housing of the cylindrical cells is external to the grip region and is disposed below the grip distal end 130*b*. In other words, the housing of the cylindrical cells is not accommodated within the internal space of the handgrip 130. This construction is thus different from a plug-in type battery, in which the housing of the cylindrical cells projects upwardly from the upper surface of the battery and the housing of the cylindrical cells is accommodated either partially or entirely within the internal space of the handgrip when the battery is attached to the power tool. In the present embodiment, the housing of the cylindrical cells of the battery 140 is external to the grip region and the battery 140 is configured as a so-called slide-type battery pack, in which the battery is attached and detached by sliding the battery 140 relative to the power tool 100. Therefore, the battery 140 can be detached by sliding the battery 140 from the attached position in the sliding direction (a direction that is generally parallel to the axial direction of the driver bit 110). After being detached from the handgrip 130, the battery 140 can be recharged by connecting it to a battery charger (not illustrated).

In the impact driver 100 having the above-described construction, when the user holds the handgrip 130 and depresses the trigger 131 to actuate a power switch, the driving motor 120 is driven. The driver bit 110 is then rotated via the speed reducing mechanism, the spindle, the hammer and the anvil and performs a screw-tightening operation. The operating principle of the impact driver 100 is known in the art and therefore will not be described in further detail.

The impact driver 100 may be operated by forwardly pressing a horizontally-extending driver bit 110, by upwardly or downwardly pressing a vertically-extending driver bit 110, or by upwardly or downwardly pressing an obliquely-extending driver bit 110.

In the following, the construction and operation of the representative handgrip 130 will be explained in further detail with reference to FIGS. 4 to 12.

In the above-described representative embodiment with the slide-type battery 140, the size and design of the internal space within the handgrip 130 is not restricted by having to internally accommodate the housing of the cylindrical cells of the battery 140. Therefore, this construction is advantageous, because it provides a greater degree of design freedom with respect to the configuration or contour of the handgrip 130. On the other hand, in a power tool designed to internally accommodate a plug-in type removable battery, the configuration or contour of the housing of the cylindrical cells accommodated within the internal space of the handgrip necessarily influences the configuration and contour of the handgrip. However, by utilizing a construction with a slide-type battery as in the representative embodiment, the configuration or contour of the housing of the cylindrical cells does not influence the configuration or contour of the handgrip, so that a greater degree of design freedom with respect to the configuration and contour of the handgrip can be provided.

Figure 4:
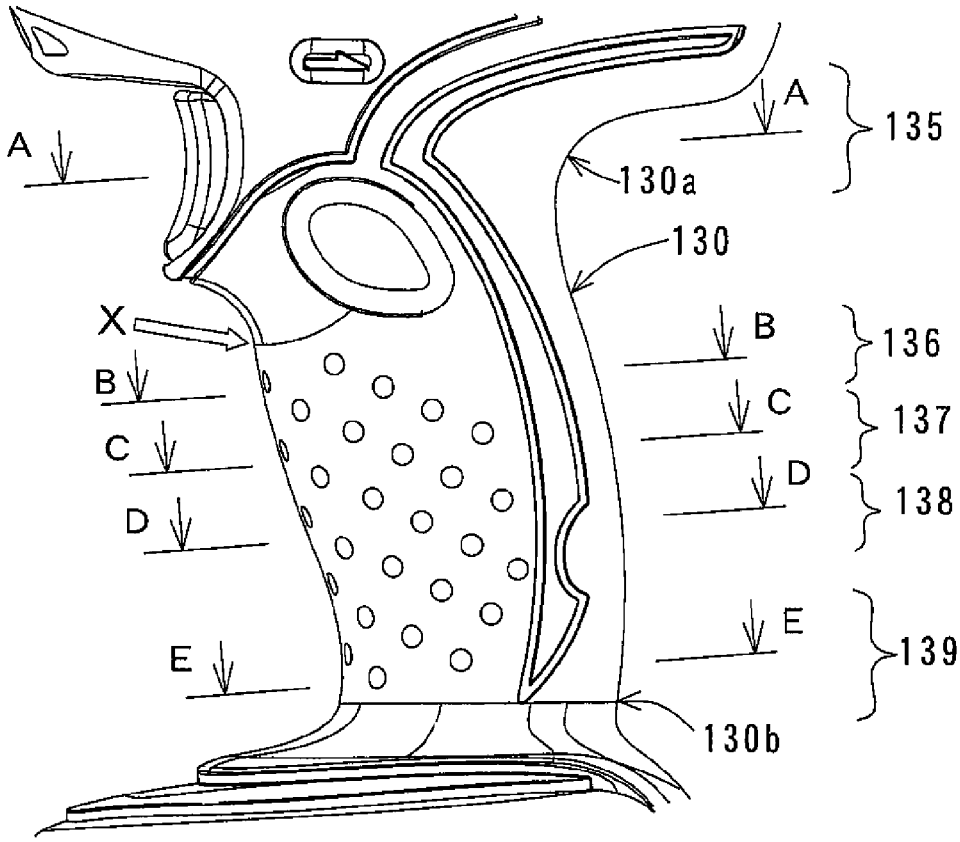
FIG. 4 is a side view of a representative handgrip 130.

FIG. 4 shows a lateral side view of the handgrip 130, in which a first grip region 135 is defined as the region where the web between the thumb and the forefinger is positioned when holding the handgrip 130. A second grip region 136 is defined as the region where the middle finger is positioned when holding the handgrip. A third grip region 137 is defined as an intermediate region where the middle finger or the ring (fourth) finger is positioned when holding the handgrip. A fourth grip region 138 is defined as the region where the ring (fourth) finger is positioned when holding the handgrip. A fifth grip region 139 is defined as the region where the little (pinky) finger is positioned when holding the handgrip. Particularly, the second to fifth grip regions 136-139 are preferably disposed, for example, within the range of 47.0 mm±2% from the grip distal end 130*b* toward the grip proximal end 130*a*.

With respect to the cross-sectional configuration of the handgrip 130 of FIG. 4, FIGS. 5 to 9 shows cross-sectional views taken along line A-A, line B-B, line C-C, line D-D and line E-E respectively shown in FIG. 4. In this embodiment, these cross-sections are parallel to a lengthwise direction of the battery 140.

Figure 5:
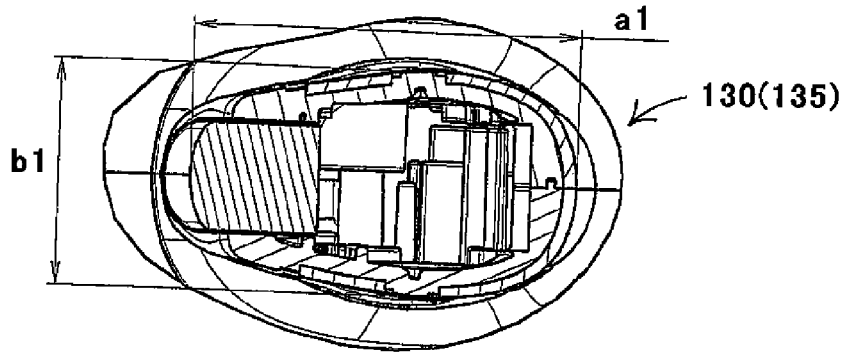
FIG. 5 is a cross-sectional view of the handgrip 130 taken along line A-A in FIG. 4

As shown in FIG. 5, the cross section of the handgrip 130 in the first grip region 135 is configured to be oval. For example, a major axis a1 is defined within the range of 53.6 mm±2% in the fore-and-aft direction of the handgrip, and a minor axis b1 is defined within the range of 31.2 mm±2% in the sidewise or lateral direction of the handgrip.

Figure 6:
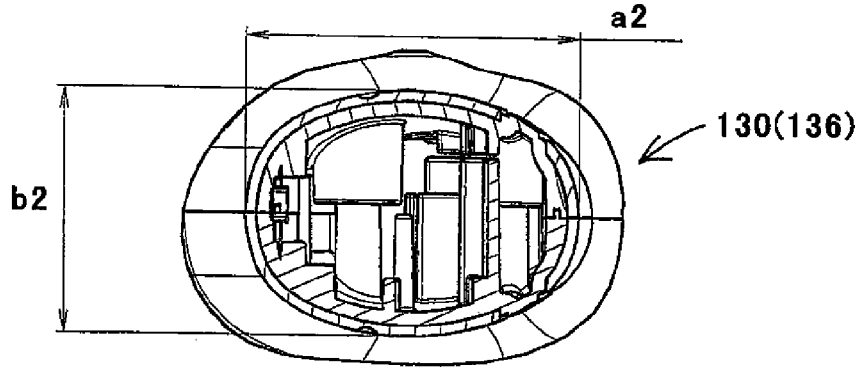
FIG. 6 is a cross-sectional view of the handgrip 130 taken along line B-B in FIG. 4.

As shown in FIG. 6, the cross section of the handgrip 130 in the second grip region 136 is configured to be oval. For example, a major axis a2 is defined within the range of 46.0 mm±2% in the fore-and-aft direction of the handgrip, and a minor axis b2 is defined within the range of 34.5 mm±2% in the sidewise or lateral direction of the handgrip.

Figure 7:
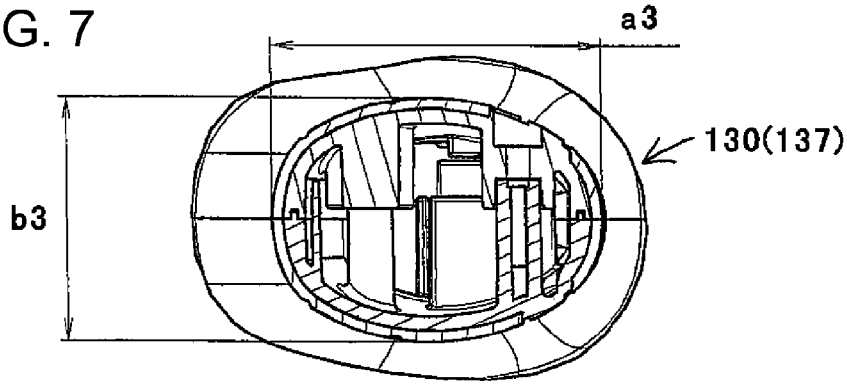
FIG. 7 is a cross-sectional view of the handgrip 130 taken along line C-C in FIG. 4.

As shown in FIG. 7, the cross section of the handgrip 130 in the third grip region 137 is configured to be oval. For example, a major axis a3 is defined within the range of 45.4 mm±2% in the fore-and-aft direction of the handgrip, and a minor axis b3 is defined within the range of 33.7 mm±2% in the sidewise or lateral direction of the handgrip.

Figure 8:
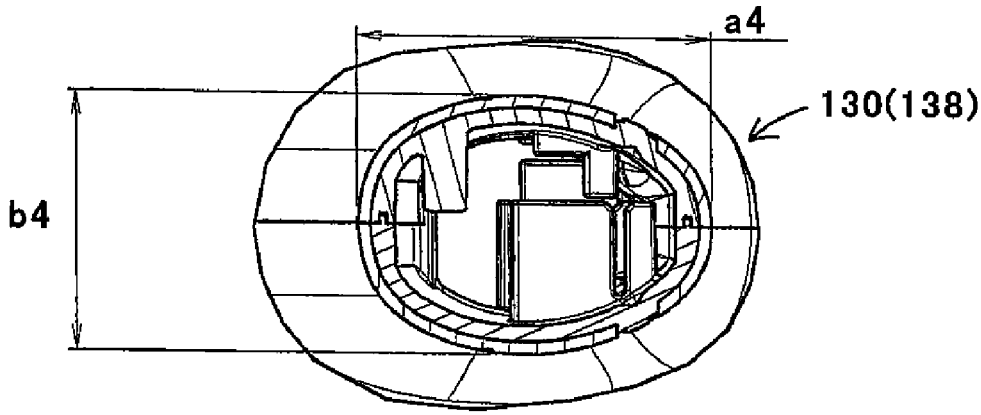
FIG. 8 is a cross-sectional view of the handgrip 130 taken along line D-D in FIG. 4.

As shown in FIG. 8, the cross section of the handgrip 130 in the fourth grip region 138 is configured to be oval. For example, a major axis a4 is defined within the range of 43.3 mm±2% in the fore-and-aft direction of the handgrip, and a minor axis b4 is defined within the range of 32.0 mm±2% in the sidewise or lateral direction of the handgrip.

Figure 9:
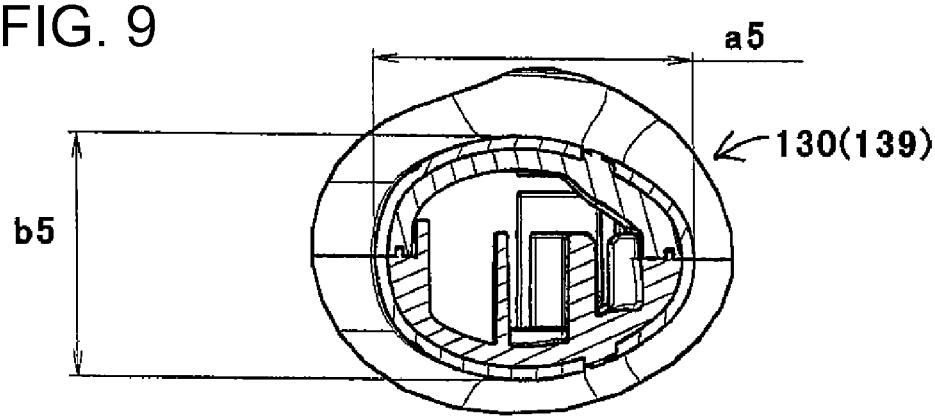
FIG. 9 is a cross-sectional view of the handgrip 130 taken along line E-E in FIG. 4.

As shown in FIG. 9, the cross section of the handgrip 130 in the fifth grip region 139 is configured to be oval. For example, a major axis a5 is defined within the range of 38.7 mm±2% in the fore-and-aft direction of the handgrip, and a minor axis b5 is defined within the range of 29.4 mm±2% in the sidewise or lateral direction of the handgrip.

As shown in FIGS. 6 to 9, between the second grip region 136 and the grip distal end 130*b*, the grip diameter (major and minor axes) is at a maximum in the second and third grip regions 136 and 137. The grip diameter (major and minor axes) of the handgrip 130 gradually reduces toward the grip distal end 130*b* and reaches a minimum in the fifth grip region 139. Although not shown, similar to the grip diameter (major and minor axes), the cross-sectional area and the perimeter of the handgrip are also at a maximum in the second and third grip regions 136 and 137, then gradually reduce toward the grip distal end 130*b* and ultimately reach a minimum in the fifth grip region 139.

Although the grip diameter (major and minor axes) of the handgrip is described in this embodiment with respect to the cross sections extending along the longitudinal direction of the battery, as another example, the grip diameter (major and minor axes) of each portion of the handgrip can be appropriately defined with consideration of the position and orientation of the cross sections, errors and tolerances.

When the user holds the handgrip, the holding force of the entire palm can be effectively utilized if the little finger can securely grip the handgrip. Giving consideration to this fact, the handgrip is configured such that the grip size (at least the grip diameter) is at a maximum in the region that is held by the middle finger or the ring finger and is at a minimum in the region that is held by the little finger. In this case, the second or the third grip region 136 or 137 may be examples that correspond to the "maximum diameter portion", and the fifth grip region 139 may correspond to the "minimum diameter portion". Further, the position of the maximum diameter portion (the region where the grip diameter is a maximum) may substantially coincide, such as in this embodiment, or may not necessarily coincide with the position of the maximum cross-section portion (the region where the cross-sectional area is a maximum) or the position of the maximum perimeter portion (the region where the grip perimeter is a maximum). Likewise, the position of the minimum diameter portion (the region where the grip diameter is a minimum) may substantially coincide, or may not necessarily coincide with the position of the minimum cross-section portion (the region where the cross-sectional area is a minimum) or the position of the minimum perimeter portion (the region where the grip perimeter is a minimum).

Further, although a cross-sectional configuration is not explicitly shown, the region X (shown in FIG. 4), which is closer to the grip proximal end 130*a* than the second grip region 136, is configured to have a smaller grip diameter, a smaller perimeter and a smaller cross-sectional area than the second grip region 136. The portion, against which the holding force of the hand is substantially exerted when the user holds the power tool by hand, is initially thinner on the side of the grip proximal end 130*a*, then becomes thicker and finally becomes thinner again towards the grip distal end 130*b*.

Figure 10:
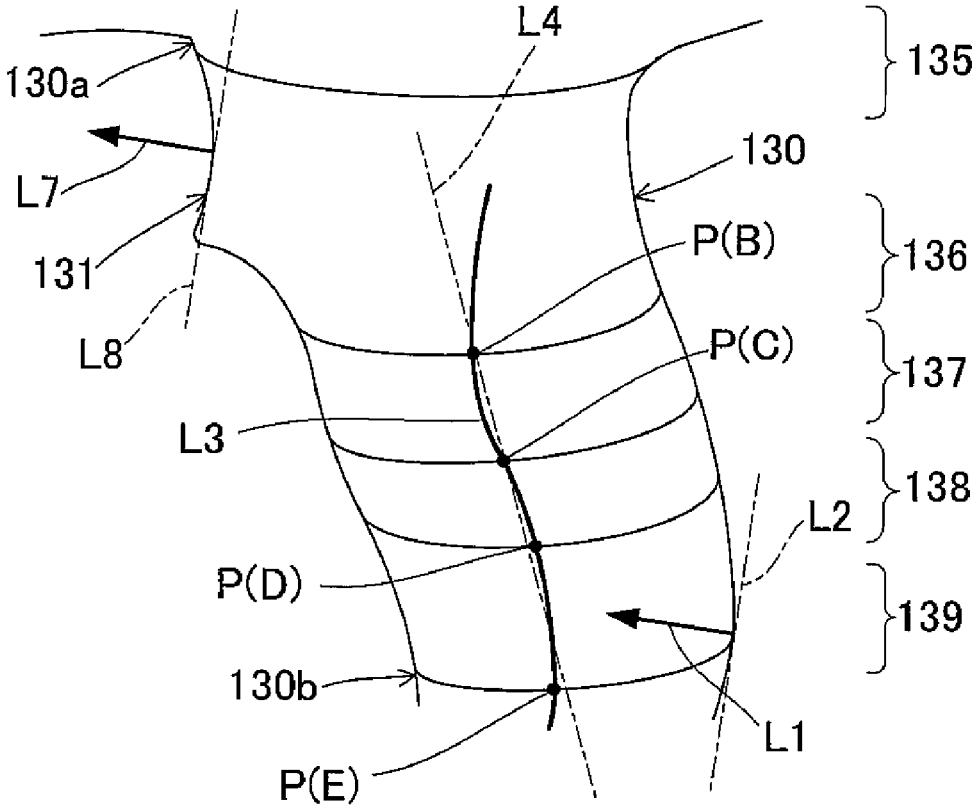
FIG. 10 schematically shows the surface contour of the representative handgrip 130.

FIG. 10 schematically shows the surface configuration of the handgrip 130 according to the representative embodiment. The handgrip 130 shown in FIG. 10 is configured such that a normal L1 extending from the rearward end surface of the region of the grip distal end 130*b* (i.e. a line perpendicular to a tangent L2 on the rearward end surface) crosses the axis of the driver bit 110 forward of the handgrip 130. In other words, the normal L1 (straight line) that extends upward and to the left as viewed in FIG. 10 crosses the axis (not explicitly represented in the drawings) of the substantially horizontally-extending driver bit 110 forward of the handgrip 130. A normal, which is similar to the normal L1 that crosses the axis of the driver bit 110 forward of the handgrip 130, may be defined at least one point in the region of the grip distal end 130*b*. For example, such a normal may be defined only on the grip distal end 130*b*. In the alternative, a plurality of such normals may be defined within a predetermined region between the grip distal end 130*b* and the grip proximal end 130*a*. In this embodiment, the normal L1 is arranged based on a "human body data analysis", which will be described below.

Further, in the handgrip 130 shown in FIG. 10, a curved line L3 is defined by an imaginary line that continuously and vertically connects the vertexes of the respective oval cross-sections on the lateral side surface of the grip 130, or as a connecting line that continuously connects, for example, a vertex P (B) in the second grip region 136, a vertex P (C) in the third grip region 137, a vertex P (D) in the fourth grip region 138 and a vertex P (E) in the fifth grip region 139. As shown in FIG. 10, the curved line L3 extends in the shape of the letter S such that the upper end of the line is directed toward the rearward end of the grip proximal end 130*a* and the lower end of the line is directed toward the front or forward end of the grip distal end 130*b*. In this case, when the connecting line that connects vertexes on one side or lateral surface of the grip extends in the shape of the letter S, another connecting line that connects vertexes on the other side or lateral surface of the grip is a mirror image of said connecting line (in the shape of the letter S). The curved line L3 is an example that corresponds to the "connecting line". In this embodiment, the curved line L3 or an extending line L4 that extends along the curved line L3 is arranged based on the "human body data analysis", which will be described below.

Further, the handgrip 130 shown in FIG. 10 is configured such that a normal L7 extending from the front surface of the trigger 131 (i.e. a straight line perpendicular to a tangent L8 on the front surface of the trigger 131) crosses the axis of the driver bit 110 forward of the handgrip. In other words, the normal L7 (straight line), which extends upward and to the left as viewed in FIG. 10, crosses the axis (not shown) of the substantially horizontally-extending driver bit 110 forward of the handgrip. The front surface of the trigger 131 comprises a contact region that is depressed by the user's forefinger. A normal, such as the normal L7 that crosses the axis of the driver bit 110 forward of the handgrip, may be formed at one or more points on the front surface of the trigger 131. In this embodiment, the normal L7 is arranged based on the "human body data analysis", which will be described below.

The configuration or contour of the handgrip 130 is designed based on the above-mentioned human body data analysis, a sensory evaluation analysis and a mechanical simulation analysis that will now be described. As a result of verification by an evaluation that used the mechanical simulation analysis and the sensory evaluation analysis, the representative handgrip 130 was found to reduce the load on the user's fingers and enabled comfortable long operating times.

Figure 11:
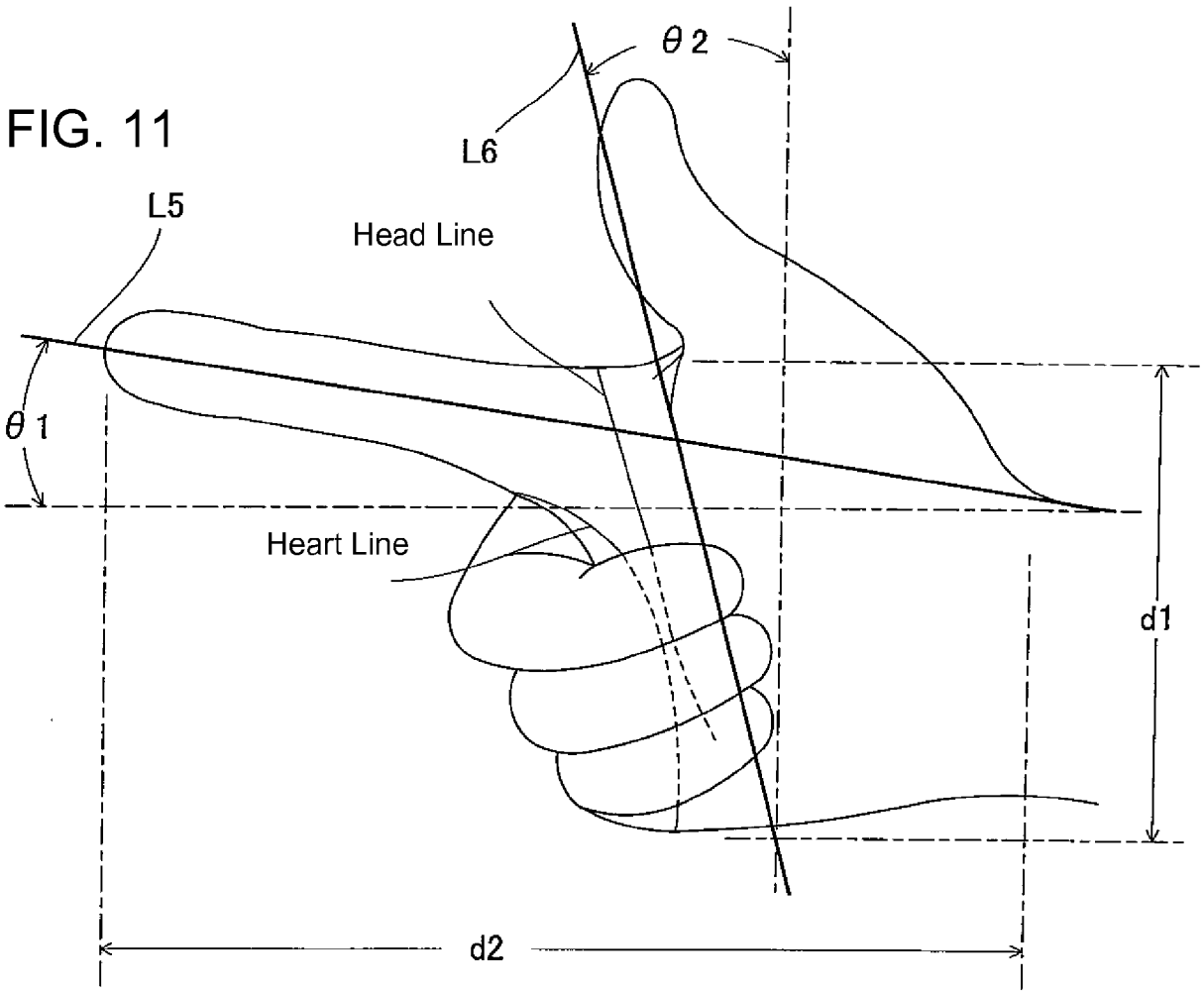
FIG. 11 shows the shape of the fingers and the palm in the state of holding the handgrip, wherein the handgrip is omitted for illustration purposes.

In order to examine the shape of the fingers and palm of users holding the handgrip, an investigation of the shape of the fingers and palm was conducted on 30 adult Japanese men, ages 20 to 40. As shown in FIG. 11, the vertical distance d1 from the lower side of the hand to the web averaged 82 mm and the horizontal distance d2 from the base of the hand to the forefinger averaged 181 mm. Further, a first angle θ1 defined between a line L5 extending along the straightened forefinger and a horizontal line averaged 10°, and a second angle θ2 defined between a line L6 extending generally vertically along a hollow (concave) portion of the palm and a vertical line averaged 15°. The line L6 can be defined as a line that extends substantially alongside the heart line or the head line on the palm.

In this embodiment, the handgrip 130 is configured such that the above-mentioned normal L1 (related to the grip configuration) extending from the rearward end surface of the grip extends alongside or parallel to the line L5. With this configuration, the pressing force exerted on the rearward end surface of the handgrip 130 can act evenly across the entire handgrip 130.

Further, in this embodiment, the handgrip is configured such that the above-mentioned extending line L4 or the curved line L3 (related to the grip configuration) on the grip side or lateral surface extends along or parallel to the line L6. In other words, considering the fact that a hollow (concave) portion is formed in the palm while it is holding the grip, in particular along the heart line and the head line, the handgrip is configured such that the vertexes (convex portions) of the grip side surface extend along or are parallel to this hollow portion of the palm and are fitted into the hollow (concave) portion. With this configuration, the user can hold the handgrip evenly using the entire palm.

Further, in this embodiment, the handgrip 130 is configured such that the above-mentioned normal L7 (related to the grip configuration) extending from the front surface of the trigger 131 extends along the line L5. In other words, the position and orientation of the trigger 131 are defined based on the first angle θ1 shown in FIG. 11 so that the user can easily depress the trigger 131 with the forefinger and the force of the forefinger can be easily exerted onto the trigger.

A sensory evaluation analysis was conducted on the handgrip 130, as well as various known handgrips, using questionnaires given to sampling subjects who were chosen in a manner similar to the above-described human body data analysis. The questionnaires included questions concerning the feel of the hold, which the subject experienced (whether it fit or conformed to the hand well) while actually holding the handgrip. The results showed that the subjects preferred the handgrip according to the representative embodiment, which is configured to have a substantially thin grip diameter over its entirety, is configured such that the grip diameter gradually decreases from the portion for the middle finger towards the portion for the little finger via the grip portion for the ring finger, and is also configured such that the entire palm evenly contacts the surface of the handgrip.

Further, a mechanical simulation analysis was conducted on the handgrip 130 of this embodiment as well as comparative examples. In this analysis, a grasping force distribution on the handgrip surface of each of the handgrips was obtained, and pressure and skin shearing stress on each part of the fingers and palm (the web, the part between the forefinger to the little finger, and the palm) were calculated based on the grasping force distribution. As a result, by using the handgrip 130 of this embodiment, favorable values could be realized with respect to the pressure and skin shearing stress on each part of the fingers and palm.

Figure 12:
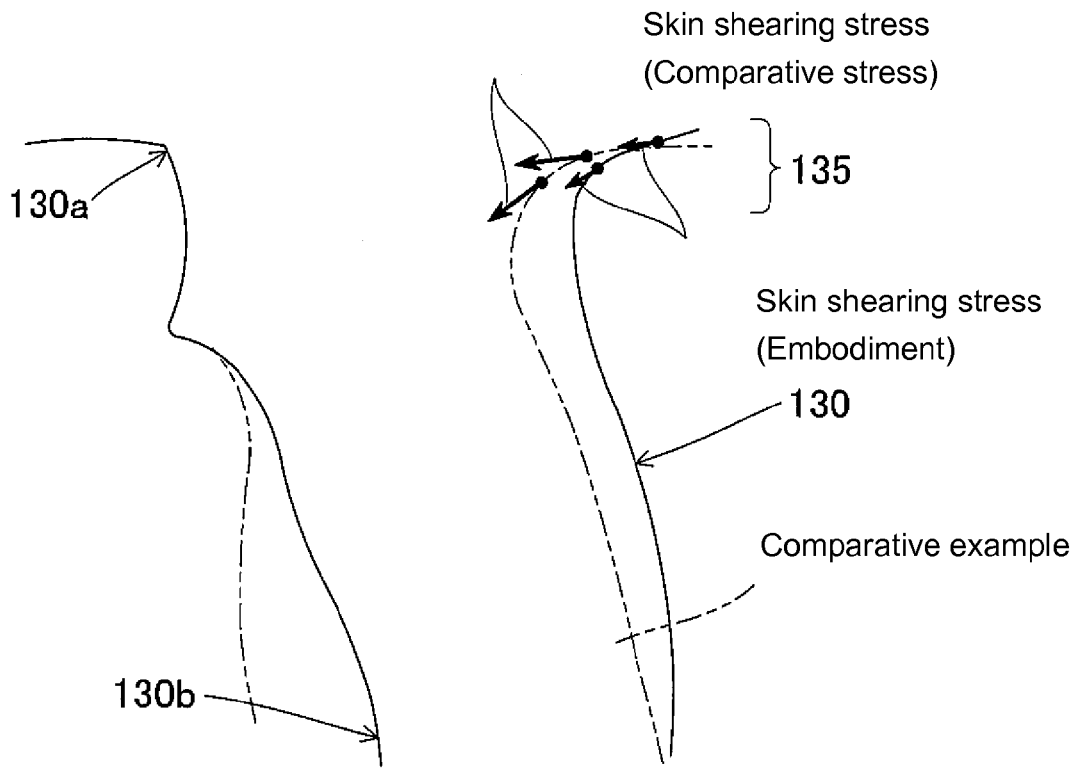
FIG. 12 shows the distribution of skin shearing stress on the web between the thumb and the forefinger as a result of a mechanical simulation analysis on the representative handgrip 130 and on a comparative example.

In this connection, FIG. 12 shows the distribution of skin shearing stress on the web as determined by the mechanical simulation analysis on the handgrip 130 for the representative embodiment and a comparative example. A handgrip having the configuration shown by a phantom line in FIG. 12 was used as the comparative example. As shown in FIG. 12, as compared to the comparative example, the skin shearing stress of the fingers and palm on the handgrip is remarkably reduced by using the handgrip of the representative embodiment. Thus, the handgrip of the representative embodiment may have a configuration which can prevent the user from suffering pain in the web portion of the hand.

As mentioned above, the handgrip 130 can take some of the load off the user's fingers. Thus, a handgrip configuration can be realized which is easy to hold, reduces user fatigue and causes less pain in the user's hand (particularly in the web) during a power tool operation.

More specifically, in the embodiment in which the normal L1 extending from the rearward end surface of the region of the grip distal end 130*b* crosses the axis of the driver bit 110 forward of the handgrip, the pressing force exerted on the rearward end surface of the handgrip 130 can act evenly over the entire handgrip 130 when the user performs a power tool operation, in which the hand holding the grip moves the power tool in its forward direction. Thus, the user can perform the power tool operation while his/her hand evenly presses the handgrip 130 in the direction towards the tip end of the tool. Therefore, a handgrip configuration can be realized that reduces fatigue and causes less pain in the user's hand during the power tool operation. Especially with the embodiment in which the normal L1 extends along the line L5, a handgrip configuration can be realized in which the pressing force generated by the user's hand pressing the handgrip 130 is readily transmitted to the axis of the driver bit 110. Such a configuration of the handgrip 130 is particularly advantageous in power tools, which the user may operate for many hours while pressing the tool bit in various directions.

Further, according to the representative embodiment, the grip dimensions (grip diameter, grip cross-sectional area, grip perimeter) gradually decrease from the region intended to be gripped by the middle finger or the ring finger, towards the grip distal end region and is minimal, in particular, in the region intended to be gripped by the little finger. With this configuration or contour, the holding force of the entire palm can be effectively utilized. As to the grip dimensions (grip diameter, grip cross-sectional area, grip perimeter), optimum values can be selected according to variations in size of the fingers and palm by race, sex or age. For example, the grip dimensions of handgrips designed specifically for Europeans and Americans can be scaled up (grip diameter, grip cross-sectional area, grip perimeter) to about 106 to 110% or preferably about 108% of those designed for Asians, while maintaining the same basic grip performance.

Further, in the configuration in which a curved line L3 continuously and vertically connects vertexes on the lateral side surface of the grip and extends in the shape of the letter S substantially along the heart line or the head line of the palm holding the grip, the vertexes (convex portions) of the lateral side surfaces of the grip snugly fit into the hollow (concave) portion of the palm, so that a handgrip having an excellent fit can be realized.

Further, in this embodiment, because the normal L7 extending from the front surface of the trigger 131 extends along the direction that the forefinger extends when straightened from its grip holding position, the user can easily depress the trigger 131 with the forefinger and can easily exert the force of the forefinger on the trigger.

Further, by using a battery 140 that has its cylindrical cell housing disposed outside the grip region, a greater degree of design freedom is provided with respect to the configuration and contour of the handgrip 130. This is effective for realizing a handgrip that is advantageously configured to reduce the load on the user's fingers.

This invention is not limited to an impact driver 100, and can also be applied to various other power tools which are used for cutting, grinding, polishing, nailing, riveting or drilling. In this regard, the power tool may be configured such that the tool bit is driven by a driving motor that is powered by an AC power source or a battery, or is driven by air or gas pressure.

It is explicitly stated that all features disclosed in the description and/or the claims are intended to be disclosed separately and independently from each other for the purpose of original disclosure as well as for the purpose of restricting the claimed invention independent of the composition of the features in the embodiments and/or the claims. It is explicitly stated that all value ranges or indications of groups of entities disclose every possible intermediate value or intermediate entity for the purpose of original disclosure as well as for the purpose of restricting the claimed invention, in particular as limits of value ranges.

REFERENCE NUMBER LIST

100 impact driver (power tool)
101 body
103 motor housing
105 gear housing
107 side contact portion
109 rearward end contact portion
110 driver bit (tool bit)
120 driving motor
130 handgrip
130*a* grip proximal end
130*b* grip distal end
131 trigger
132 grip front contact portion
133 grip rear contact portion
134 connecting portion
135 first grip region
136 second grip region
137 third grip region
138 fourth grip region
139 fifth grip region
140 battery

We claim:

1. A power tool, comprising:

a housing configured to accommodate at least an electric motor, a tool bit extending from a forward portion of the housing along an axial direction of the housing, a handgrip extending obliquely rearward from the housing with respect to the axial direction, and a trigger configured to actuate the electric motor and disposed on a forward portion of the handgrip adjacent to the tool bit, wherein at least first and second cross-sections of the handgrip taken in a direction parallel to the axial direction are each at least substantially oval, the first cross-section is disposed in a longitudinal intermediate region of the handgrip configured to be grasped by one of a middle finger and a ring finger while a forefinger is grasping the trigger, the second cross-section is disposed in a longitudinal distal region of the handgrip adjacent to a battery holder located on a terminal end of the handgrip, the second cross-section being configured to be grasped by a pinky finger while the forefinger is grasping the trigger, the first cross-section has a first cross-sectional area and the second cross-section has a second cross-sectional area, the first cross-sectional area being greater than the second cross-sectional area, a rearward end surface of the handgrip outwardly bulges in a rearward direction along a longitudinal direction extending from the housing to the terminal end of the handgrip, the longitudinal direction being at least substantially perpendicular to the axial direction, at least a forward end surface of the handgrip, which is opposite of the rearward end surface, is covered with a cushion material at least in the longitudinal direction between the first cross-section and the second cross-section, a first normal extends obliquely upward from the rearward end surface of the longitudinal distal region of the handgrip towards the axial direction of the housing, a second normal extends obliquely upward from a surface of the trigger towards the axial direction of the housing and the first normal extends in parallel with the second normal, a rearmost edge of the housing in the axial direction is disposed farther rearward than a rearmost edge of the battery holder in the axial direction, and the battery holder is configured to receive and engage a battery pack.

2. A power tool according to claim 1, wherein:

the handgrip has a plurality of at least substantially oval cross-sections between the first and second cross-sections as taken in the direction parallel to the axial direction, and cross-sectional areas of the plurality of oval cross-sections taken in the direction parallel to the axial direction gradually decrease in the direction from the first cross-section to the second cross-section.

3. A power tool according to claim 1, wherein the first cross-sectional area is the maximum cross-sectional area of the handgrip as taken in the direction parallel to the axial direction.

4. A power tool according to claim 1, wherein the second cross-sectional area is the minimum cross-sectional area of the handgrip as taken in the direction parallel to the axial direction.

5. A power tool according to claim 1, wherein the handgrip includes a third cross-section taken in a direction parallel to the axial direction, wherein the third cross-section is at least substantially oval, the third cross-section is disposed between the housing body and the longitudinal intermediate region and is configured to be grasped by the middle finger while the forefinger is grasping the trigger, the third cross-section having a third cross-sectional area, which is less than the first cross-sectional area.

6. A power tool according to claim 5, wherein cross-sectional areas of the handgrip taken in the direction parallel to the axial direction gradually increase in the direction from the third cross-section to the first cross-section.

7. A power tool according to claim 1, wherein:

the cushion material is disposed on at least a first portion of a periphery of the first cross-section, the first portion being disposed on the forward end surface of the handgrip, and a hard material is disposed on at least a second portion of the periphery of the first cross-section, the cushion material being softer than the hard material.

8. A power tool according to claim 7, wherein the second portion of the periphery of the first cross-section is located at least on a lateral side of the handgrip between the forward end surface and the rearward end surface in the axial direction.

9. A power tool according to claim 1, wherein the battery holder extends a first distance forward of the handgrip in the axial direction and extends a second distance rearward of the handgrip in the axial direction, the first distance being longer than the second distance.

10. A power tool according to claim 1, further comprising a battery pack removably attached to the battery holder, wherein a greater portion of the battery pack in the axial direction is disposed forward of the handgrip than rearward of the handgrip.

11. A power tool according to claim 1, wherein the housing comprises:

a motor housing configured to accommodate the electric motor, and a gear housing configured to accommodate a speed reduction gear that is coupled to the electric motor, wherein the trigger is disposed substantially parallel to a forward-most portion of the motor housing in the axial direction.

12. A power tool according to claim 1, wherein, in a direction parallel to the axial direction, the handgrip has a maximum grip diameter at the first cross-section and has a minimum grip diameter at the second cross-section.

13. A power tool according to claim 12, wherein:

the handgrip includes a third cross-section taken in a direction parallel to the axial direction, wherein the third cross-section is at least substantially oval, is disposed between the housing body and the longitudinal intermediate region and is configured to be grasped by the middle finger while the forefinger is grasping the trigger, the third cross-section having a third cross-sectional area that is less than the first cross-sectional area, the handgrip has a plurality of at least substantially oval cross-sections taken in the direction parallel to the axial direction between the third cross-section and the second cross-section, and cross-sectional areas of the handgrip gradually increase in the direction from the third cross-section to the first cross-section and gradually decrease in the direction from the first cross-section to the second cross-section.

14. A power tool according to claim 13, wherein each at least substantially oval cross-section defines a vertex on a lateral side of the handgrip and the plurality of vertices fall along an imaginary connecting line that is substantially S-shaped.

15. A power tool according to claim 14, wherein:

an upper end of the substantially S-shaped connecting line is proximal to the motor housing and is directed rearwardly and a lower end of the substantially S-shaped connecting line is proximal to the battery holder and is directed forwardly.

16. A power tool according to claim 1, wherein the battery holder is configured to receive and engage a battery pack by sliding the battery pack at least substantially in a direction parallel to the axial direction and is further configured such that a housing of the battery pack is entirely external of the handgrip when the battery pack is attached to the battery holder.

17. A power tool according to claim 1, wherein:

a major axis of the first cross-section in the axial direction has a length between 45.08 and 46.92 mm, a minor axis of the first cross-section in a lateral direction of the handgrip has a length between 33.81 and 35.19 mm, the lateral direction being perpendicular to the axial direction, a major axis of the second cross-section in the axial direction has a length between 37.926 and 39.474 mm, and a minor axis of the second cross-section in the lateral direction of the handgrip has a length between 28.812 and 29.988 mm.

18. A power tool according to claim 17, wherein:

a fourth cross-section and a fifth cross-section are defined between the first cross-section and the second cross-section and are each at least substantially oval, a major axis of the fourth cross-section the axial direction has a length between 44.492 and 46.308 mm, a minor axis of the fourth cross-section in the lateral direction of the handgrip has a length between 33.026 and 34.374 mm, a major axis of the fifth cross-section in the axial direction has a length between 42.434 and 44.166 mm, and a minor axis of the fifth cross-section in the lateral direction of the handgrip has a length between 31.36 and 32.64 mm.

19. A power tool according to claim 1, wherein:

the handgrip has a plurality of at least substantially oval cross-sections between the first and second cross-sections as taken in the direction parallel to the axial direction, cross-sectional areas of the plurality of oval cross-sections taken in the direction parallel to the axial direction gradually decrease in the direction from the first cross-section to the second cross-section, the second cross-sectional area is the minimum cross-sectional area of the handgrip as taken in the direction parallel to the axial direction, the cushion material is disposed on at least a first portion of a periphery of the first cross-section, the first portion being disposed on the forward surface of the handgrip, a material, which is harder than the cushion material, is disposed on at least a second portion of the periphery of the first cross-section, the battery holder extends a first distance forward of the handgrip in the axial direction and extends a second distance rearward of the handgrip in the axial direction, the first distance being longer than the second distance, and a battery pack is removably attached to the battery holder, wherein a greater portion of the battery pack in the axial direction is disposed forward of the handgrip than rearward of the handgrip.

20. A power tool according to claim 19, wherein:

the first cross-sectional area is the maximum cross-sectional area of the handgrip as taken in the direction parallel to the axial direction, the handgrip includes a third cross-section taken in the direction parallel to the axial direction, wherein the third cross-section is at least substantially oval, is disposed between the housing body and the longitudinal intermediate region and is configured to be grasped by the middle finger while the forefinger is grasping the trigger, the third cross-section having a third cross-sectional area that is less than the first cross-sectional area, and cross-sectional areas of the handgrip taken in the direction parallel to the axial direction gradually increase in the direction from the third cross-section to the first cross-section, all of the cross-sections are oval, a major axis of the first cross-section in the axial direction has a length between 45.08 and 46.92 mm, a minor axis of the first cross-section in a lateral direction of the handgrip has a length between 33.81 and 35.19 mm, the lateral direction being perpendicular to the axial direction, a major axis of the second cross-section in the axial direction has a length between 37.926 and 39.474 mm, a minor axis of the second cross-section in the lateral direction of the handgrip has a length between 28.812 and 29.988 mm, a fourth cross-section and a fifth cross-section are defined between the first cross-section and the second cross-section and are each at least substantially oval, a major axis of the fourth cross-section the axial direction has a length between 44.492 and 46.308 mm, a minor axis of the fourth cross-section in the lateral direction of the handgrip has a length between 33.026 and 34.374 mm, a major axis of the fifth cross-section in the axial direction has a length between 42.434 and 44.166 mm, and a minor axis of the fifth cross-section in the lateral direction of the handgrip has a length between 31.36 and 32.64 mm.

21. A power tool according to claim 20, wherein the battery holder is configured to receive and engage a battery pack by sliding the battery pack at least substantially in a direction parallel to the axial direction and is further configured such that a housing of the battery pack is entirely external of the handgrip when the battery pack is attached to the battery holder.

22. A power tool according to claim 19, wherein the housing comprises:

a motor housing configured to accommodate the electric motor, and a gear housing configured to accommodate a speed reduction gear that is coupled to the electric motor, wherein the trigger is disposed substantially parallel to a forward-most portion of the motor housing in the axial direction, the second portion of the periphery of the first cross-section covered with the material, which is harder than the cushion material, is located at least on a lateral side of the handgrip between the forward end surface and the rearward end surface in the axial direction, a major axis of the first cross-section in the axial direction has a length between 45.08 and 46.92 mm, a minor axis of the first cross-section in a lateral direction of the handgrip has a length between 33.81 and 35.19 mm, the lateral direction being perpendicular to the axial direction, a major axis of the second cross-section in the axial direction has a length between 37.926 and 39.474 mm, a minor axis of the second cross-section in the lateral direction of the handgrip has a length between 28.812 and 29.988 mm, a fourth cross-section and a fifth cross-section are defined between the first cross-section and the second cross-section and are each at least substantially oval, a major axis of the fourth cross-section the axial direction has a length between 44.492 and 46.308 mm, a minor axis of the fourth cross-section in the lateral direction of the handgrip has a length between 33.026 and 34.374 mm, a major axis of the fifth cross-section in the axial direction has a length between 42.434 and 44.166 mm, a minor axis of the fifth cross-section in the lateral direction of the handgrip has a length between 31.36 and 32.64 mm; and the battery holder is configured to receive and engage a battery pack by sliding the battery pack at least substantially in a direction parallel to the axial direction and is further configured such that a housing of the battery pack is entirely external of the handgrip when the battery pack is attached to the battery holder.

* * * * *